US005151683A

United States Patent [19]

Takahashi et al.

[11] Patent Number: 5,151,683

[45] Date of Patent: Sep. 29, 1992

[54] POWER SUPPLY CONTROL DEVICE IN FIRE ALARM SYSTEM

[75] Inventors: Kaoru Takahashi; Akio Tsumuji; Ryuji Shutoku, all of Tokyo, Japan

[73] Assignee: Nohmi Bosai Co., Ltd., Tokyo, Japan

[21] Appl. No.: 468,865

[22] Filed: Jan. 23, 1990

[30] Foreign Application Priority Data

Jan. 31, 1989 [JP] Japan ..... 1-20988
Jan. 31, 1989 [JP] Japan ..... 1-20989

[51] Int. Cl.[5] ..... G08B 26/00

[52] U.S. Cl. ..... 340/518; 340/505; 340/514; 340/588

[58] Field of Search ..... 340/505, 506, 514, 693, 340/825.06, 510-512, 661, 588

[56] References Cited

U.S. PATENT DOCUMENTS 4,785,284 11/1988 Kimura ..... 340/505
4,816,808 3/1989 Morita ..... 340/518
4,847,593 7/1989 Igarashi ..... 340/505
4,962,373 10/1990 Sirois ..... 340/693

*Primary Examiner*—Donnie L. Crosland
*Attorney, Agent, or Firm*—Wenderoth, Lind & Ponack

[57] ABSTRACT

A power supply control device is provided in a fire alarm system having terminals such as fire detectors and/or repeaters with comparators to detect abnormalities such as fire or an operating status of controlled apparatus, and is equipped with a reference voltage supply a source to supply reference voltage to the comparators, and a power supply control to allow the reference voltage to be supplied to the comparators only during the detecting time.

4 Claims, 4 Drawing Sheets

POWER SUPPLY CONTROL DEVICE IN FIRE ALARM SYSTEM

DETAILED DESCRIPTION OF THE INVENTION

The present invention relates to a power supply control device in a fire alarm system, particularly for terminals such as fire detectors and/or repeaters.

Prior Art and its Problems

It is required that fire alarm systems maintain their functions for several hours even in case of a main power failure, and sound emergency bells for a predetermined length of time if fire breaks out during the power failure. To cope with these requirements, control panels are equipped with emergency power supplies (rechargeable batteries).

Each of terminals, such as a fire detector and a repeater, is equipped with a comparator to judge whether an abnormality such as fire has occurred, or to check whether or not a controlled apparatus, such as a fire door, is in the properly controlled state. This comparator consumes, comparatively large amount of power. Among others, current consumption at the reference voltage supply source which supplies the reference voltage needed for the above mentioned judgment or check is so large that the power consumption of the fire alarm system as a whole becomes greater.

Furthermore, the longer the power supply/signal lines are extended, the greater the influence of power consumption becomes.

In a fire alarm system employing a polling system, each of the terminals, such as a fire detector and repeater, is equipped with a dip-switch, which is used for setting a predetermined value indicating the self-address and/or kind of the terminal. When a repeater is called from the control panel, the address transmitted by the control panel is checked with the self-address, and if they match, the repeater performs the operation in accordance with the control command from the control panel.

In the case of this system, a current flows through the dip-switch circuit at all times, enabling an address from the control panel to be checked with the self-address, and/or kind of terminal to be discriminated. The circuit for checking the self-addresses and/or discriminating kind of the terminal consumes a comparatively large amount of power, and consequently the fire alarm system as a whole consumes a large amount of power.

SUMMARY OF THE INVENTION

The first object of the present invention is to offer a power supply control device for the fire alarm system which can reduce power consumption at the reference voltage supply source which supplies a reference voltage to the comparator.

The second object of the present invention is to offer a power supply control device for the fire alarm system which can reduce power consumption in the circuit for checking the address from the control panel with the self-address and/or discriminating the kind of terminal.

The third object of the present invention is to offer a power supply control device for the fire alarm system which can reduce power consumption in the reference voltage supply source which supplies a reference voltage to the comparator in the terminal, and in the circuit for checking the address from the control panel with the self-address and/or discriminating the kind of terminal.

The present invention is intended to supply a reference voltage to the comparators which detect the predetermined level or signal of abnormality such as fire or the signal indicating the status of the controlled apparatus only during the detecting time.

The present invention is intended to supply power to a switch means, such as dip-switch which set the self-addresses and/or kind of the terminals at the initial time, i.e. at the time of switch on of the power supply and/or resetting, and to read the self-addresses and/or kind of terminals from the switch means and write them in the RAM.

The power supply control device according to the present invention is provided for control of the reference voltage supply to the comparators which detect the predetermined level or signal of abnormality such as fire, or signals indicating the status of the controlled apparatus such as, a fire door or smoke damper. By supplying reference voltage to the comparators only during the detecting time, the electrical power consumed by the reference voltage supply source of the comparator is lessened, and thus, the power consumption of the fire alarm system as a whole can be reduced.

Also, the present invention can reduce power consumption in the circuit which checks the address from the control panel with the self-address and/or the circuit which discriminates kind of the terminal because power is supplied to the switch means such as the dip-switch at the initial time, i.e. at the time of switch on of the power supply and/or resetting, and the self-addresses and/or the kind of terminals are read from the switch means and written in the RAM, then the written self-addresses and/or kind stored in the RAM are used thereafter.

DETAILED DESCRIPTION OF THE EMBODIMENT

Figure 1:
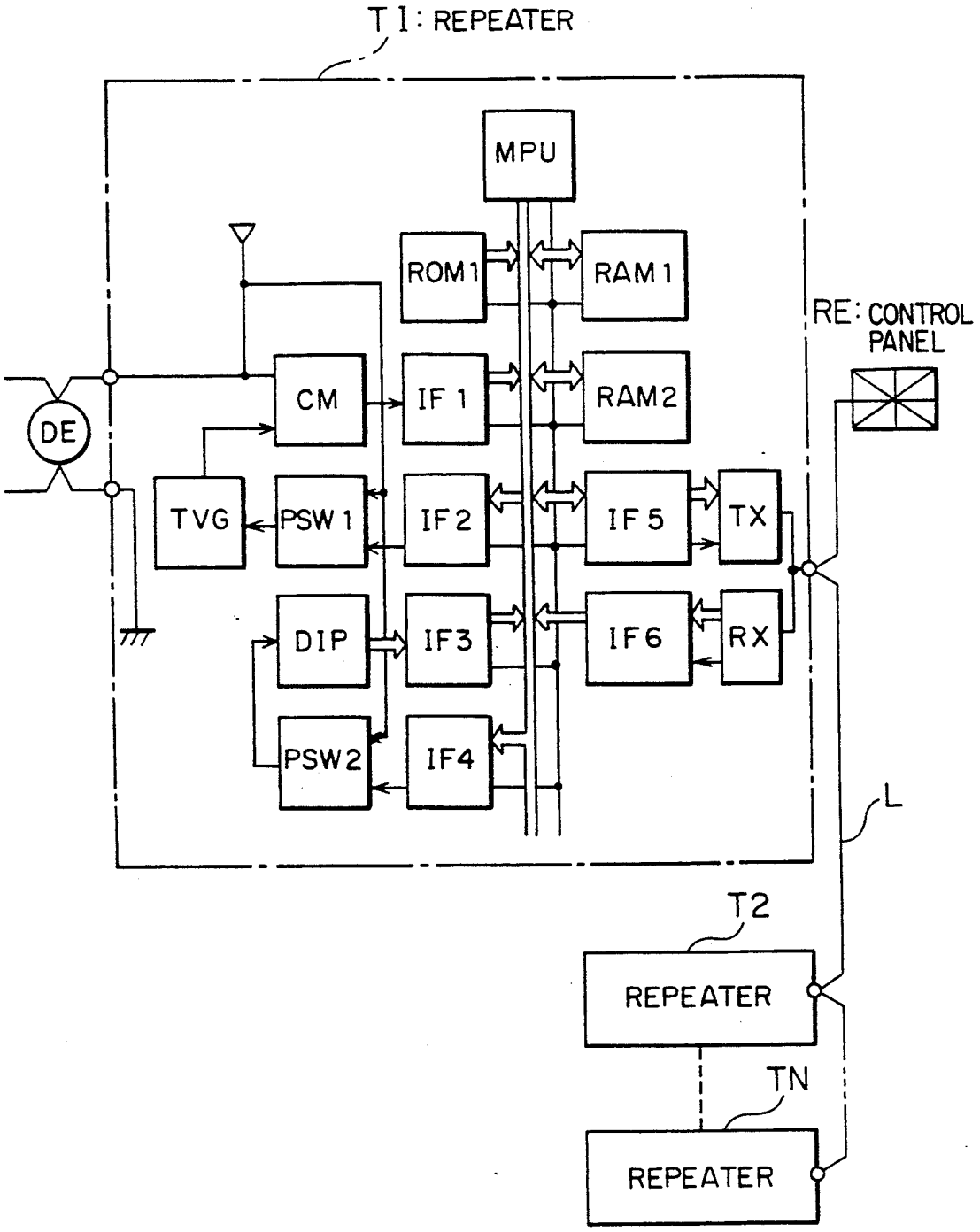
FIG. 1 is a block diagram showing an embodiment of the present invention.

FIG. 1 is a block diagram showing an embodiment according to the present invention.

In this embodiment, the control panel RE and plural repeaters T1–TN as terminals are connected, for example, by a pair of power supply/signal lines L, and plural fire detectors DE are connected to the repeater T1. While in FIG. 1 the repeater T1 alone is shown, the other repeaters T2–TN are same as the repeater T1.

Figure 3:
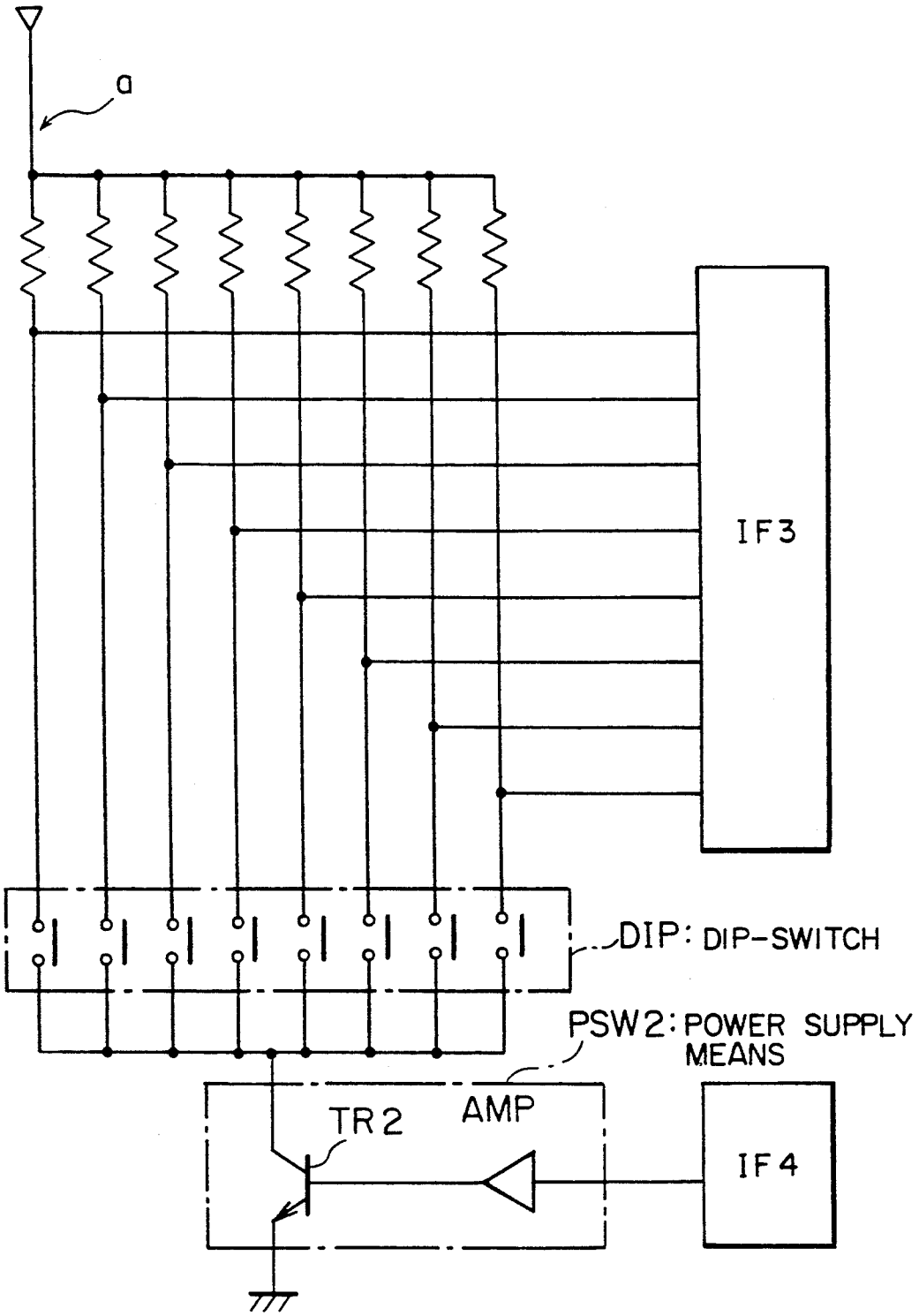

The repeater T1 is equipped with a microprocessor MPU, a ROM1 containing programs related to the flowchart shown in FIG. 3, a RAM 1 used as a work area, a RAM 2 storing the self-address of the repeater T1, a comparator CM for fire signal discrimination to detect abnormalities such as fire, a reference voltage supply source TVG for supplying a reference voltage to the comparator CM, and a power supply control means PSW1 for controlling the reference voltage supply to the comparator CM.

The repeater T1 is equipped with a dip-switch DIP used as a switch means to set the self-address of the repeater T1, a power supply means PSW 2 to supply power to the dip-switch only at the initial time, a transmission unit TX equipped with a parallel-serial converter and a transmission circuit, and a receiver unit RX equipped with a receiving circuit and a serial-parallel conversion circuit.

Figure 2:
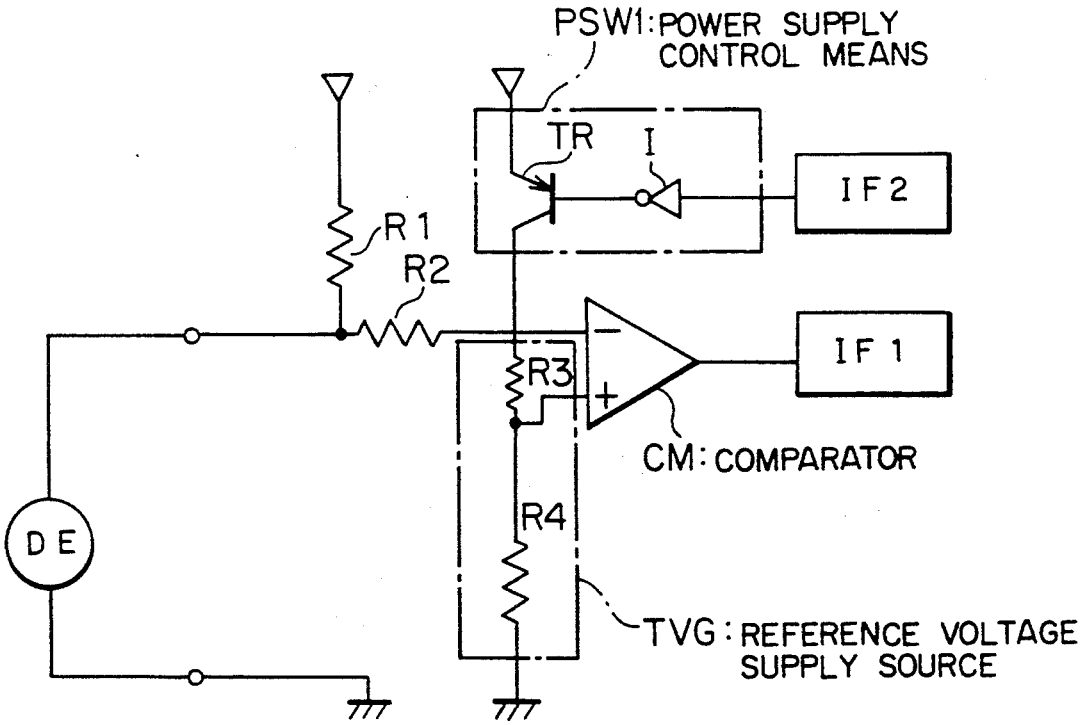
FIGS. 2 and 3 are circuit diagrams which concretely show the principal parts of the above embodiment.

FIGS. 2 and 3 are circuit diagrams which concretely show principal parts of the above embodiment. In FIG. 2 a signal from the fire detector DE is transmitted to the (−)input terminal of the comparator CM via a resistor R2, and reference voltage from the reference voltage supply source TVG is supplied to the (+)input terminal of the comparator CM. The reference voltage supply source TVG generates a reference voltage by dividing the power supply voltage by means of resistors R3 and R4, and a transistor TR is connected between the power supply and the reference voltage supply source TVG. The power supply control means PSW1 comprises transistor TR and an inverter I which inverts the signal from IF2.

An interface IF 2 generates a high output during an abnormality (such as fire) detecting time only. Upon the generation of the high output by interface IF 2, the inverter I outputs a low signal which causes the transistor TR to switch on.

The reference voltage supply source TVG is an example of a means used to supply a reference voltage to the comparator which detects abnormalities such as fire. The power supply control means PSW1 is an example of a means which allows the reference voltage to be supplied to the comparator only during the abnormality (such as fire) detecting time.

In FIG. 3 each point between each contact of the dip-switch DIP and each resistor is connected with the input terminal of an interface IF 3, and a transistor TR2 is connected between each of the above contacts and the earth. The power supply means PSW 2 is equipped with a transistor TR 2 and is an amplifier AMP, and connected to the output of an interface IF 4.

The power supply means PSW 2 is an example of a means used to supply power to the dip-switch DIP at the initial time, i.e. at the time of the switch on of the power supply or resetting. The interface IF 3 is an example of a control means used to read the self-address from the dip-switch DIP at the initial time and write the self-address in the RAM.

The operation of the above-noted embodiment will be described hereinafter.

Figure 4:
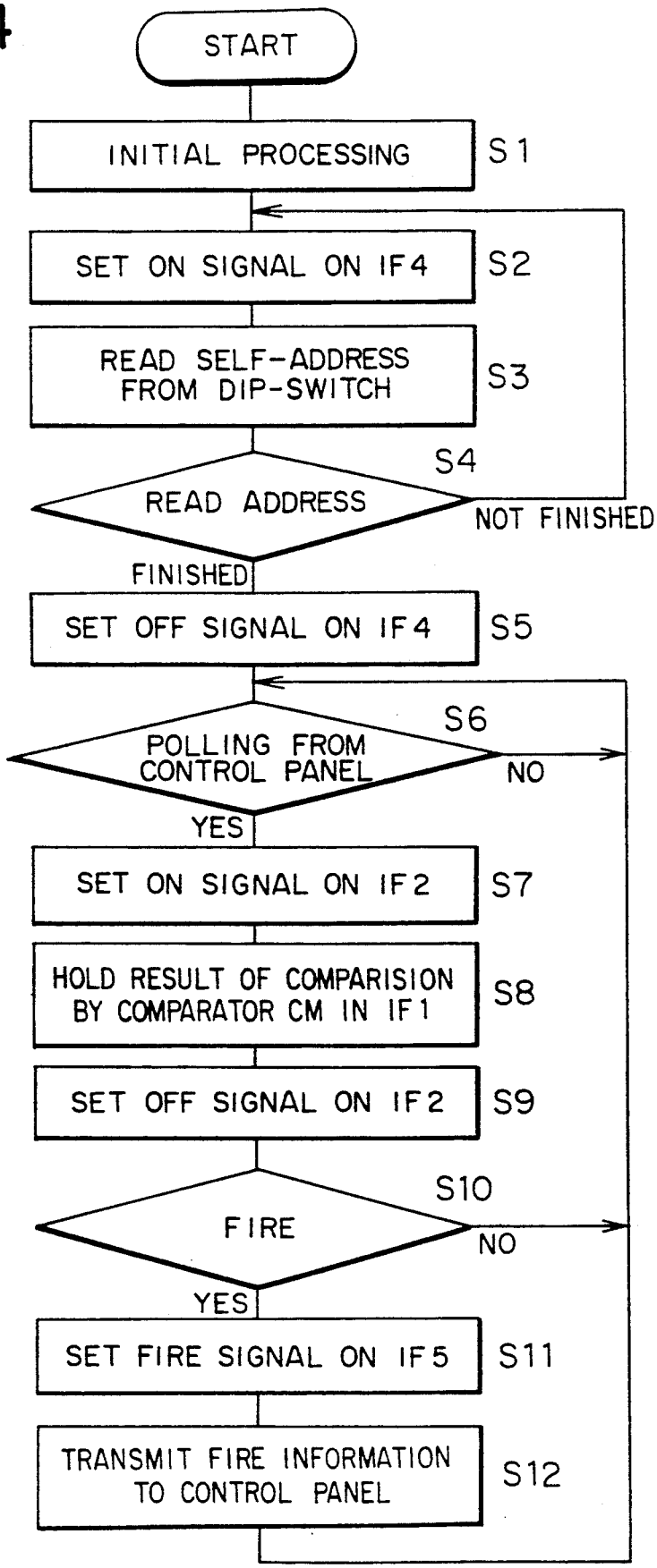
FIG. 4 is a flowchart showing operation of the above embodiment.

FIG. 4 is a flowchart showing the operation of the above-noted embodiment.

When power is supplied from the control panel RE, or a reset command is received for a fire resetting operation or the power supply is temporarily interrupted, the initial processing such as clearing the RAM 1 and the RAM 2 and setting the initial value is performed (S1). After setting the ON signal on the interface IF 4 (S2), the self-address of the repeater T 1 is read from the dip-switch DIP (S3). This self-address has previously been set at the time of mounting of the dip-switch DIP.

As the ON signal is set on the interface IF 4, the ON signal is supplied to the base of the transistor TR 2 through the amplifier AMP. With the transistor TR 2 switched on, power is supplied to the dip-switch DIP, and a signal corresponding to the content (self-address) set on the dip-switch DIP is transmitted to the interface IF 3, through which the data which has been read is written in the RAM 2.

Upon completion of the reading of the self-address (S4), the OFF signal is set on the interface IF 4 (S5). Then, the transistor TR 2 is switched off, and no current flows therefrom to the dip-switch DIP. Therefore, a useless current does not flow to the dip-switch DIP after the OFF signal has been set on the interface IF 4. In other words, current flows to the DIP switch only at the initial time, and therefore there is no waste of power.

When polling is performed from the control panel RE, and the polling address and the self-address stored in the RAM 2 have matched (S6), the ON signal is set on the interface IF 2 (S7). Then, a result of a comparison by the comparator CM, for example, the presence or absence of a fire signal is held in the interface IF 1 (S8). By using the data held in the interface IF 1, the OFF signal is set on the interface IF 2 (S9). In other words, the interface IF 2 outputs a high signal only when polling is performed from the control panel RE. Therefore, the transistor TR switches on only at this time, and the power supply control means PSW1 becomes conductive, allowing a current to flow to the reference voltage supply source TVG and allowing the reference voltage to be supplied to the (+)input terminal of the comparator CM. Upon completion of the reading the data from the comparator CM, the transistor TR switches off, interrupting the current flow to the reference voltage supply source TVG. Therefore, wasteful power is not delivered by the reference voltage supply source TVG.

In case a 'fire' decision has been made on the basis of the output signal from the comparator CM (S10), a fire signal is set on the interface IF 5 (S11), and fire information is transmitted to the control panel RE (S12).

In the above embodiment the comparator CM, the power supply control means PSW 1, the power supply means PSW 2, interfaces IF 1, IF 2, and IF 3 may be replaced by a microcomputer. Also, a timer means may be installed as the power supply control means PSW 1 so that the reference voltage can be supplied to the comparator CM based on the output of the timer means, i.e. while the timer means is generating an output.

Furthermore, the power supply means PSW 2 may be located at the position marked 'a' in FIG. 3, namely between the resistor connected in series with the dip-switch DIP and the power supply.

While the above embodiment illustrates a case with the supervisory repeater to which the fire detectors are connected, same applies to cases where the terminal is a repeater to which controlled apparatus such as a fire door and/or smoke damper are connected and which is equipped with a comparator to detect the operating signal (operating status) of the controlled apparatus, or the terminal is an abnormality detector such as fire detector equipped with a comparator to judge whether or not the fire phenomenon has exceeded a predetermined level.

The invention may also be applied to a case in which the switch means is provided on the terminal to set kinds of supervisory or control repeaters, analog or ON/OFF type fire detectors.

The present invention has an effect of reducing power consumption by the reference voltage supply source which supplies reference voltage to the comparator.

It also has an effect to reduce power consumption in the circuit which checks the address from the control panel with the self-address and/or sets and discriminates the kind of repeater. Furthermore, it has an effect of improving the signal processing speed and to shorten, in the case of a polling system, the polling time because the reading of the address and kind from the switch means are performed only at the initial time, i.e. at the time of switch on of the power supply and resetting, and the operations are carried out with the memories of the RAM thereafter.

What is claimed is:

1. In a fire alarm system terminal, an apparatus comprising:

a comparator for receiving a detection signal from a fire detection apparatus and for discriminating a fire phenomenon by comparing the detection signal with a reference voltage during a detection period in which the fire alarm system terminal is activated to detect the fire phenomenon;

a reference voltage supply means for selectively generating and outputting the reference voltage to said comparator; and, a power supply control means for causing said reference voltage supply means to generate and output the reference voltage to said comparator only during said detection period.

2. In a fire alarm system terminal, an apparatus comprising:

switch means for generating, in response to a power supply signal applied thereto, at least one of a self-address of the fire alarm system terminal and a type-indication of the fire alarm system terminal;

power supply means for applying said power supply signal to said switch means only during an initial time period following initialization of the fire alarm system terminal, wherein said at least one of said self-address and said type-indication is generated by said switch means only during said initial time period; and, control means for reading said at least one of said self-address and said type-indication generated by said switch means during said initial time period and for writing the thus read at least one of said self-address and said type-indication in a random access memory of the fire alarm system terminal, said initial time period terminating upon said writing of said at least one of said self-address and said type-indication.

3. In a fire alarm system terminal, an apparatus comprising:

a comparator for receiving a detection signal from a fire detection apparatus and for discriminating a fire phenomenon by comparing the detection signal with a reference voltage during a detection period in which the fire alarm system is activated to detect the fire phenomenon;

a reference voltage supply means for selectively generating and outputting the reference voltage to said comparator;

a power supply control means for causing said reference voltage supply means to generate and output the reference voltage to said comparator only during said detection period;

switch means for generating, in response to a power supply signal applied thereto, at least one of a self-address of the fire alarm system terminal and a type-indication of the fire alarm system terminal;

power supply means for applying said power supply signal to said switch means only during an initial time period following initialization of the fire alarm system terminal, wherein said at least one of said self-address and said type-indication is generated by said switch means only during said initial time period; and, control means for reading said at least one of said self-address and said type-indication generated by said switch means during said initial time period and for writing the thus read at least one of said self-address and said type-indication in a random access memory of the fire alarm system terminal, said initial time period terminating upon said writing of said at least one of said self-address and said type-indication.

4. An apparatus as recited in any one of claims 1 or 3, wherein said power supply control means causes said reference voltage to be supplied to said comparator in response to the fire alarm system terminal being accessed by a control panel.

* * * * *